US006555794B2

(12) United States Patent
Leutner et al.

(10) Patent No.: US 6,555,794 B2
(45) Date of Patent: Apr. 29, 2003

(54) ELECTRIC STOVE FOR COOKING FOOD HAVING AN ELECTRICALLY HEATED COOKING SURFACE

(75) Inventors: Kurt Leutner, Mainz (DE); Oliver Gros, Rheinböllen (DE); Joachim Grützke, Zaberfeld (DE); Bernhard Götz, Zaisenhausen (DE); Walter Gramlich, Bruchsal (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/931,586

(22) Filed: Aug. 16, 2001

(65) Prior Publication Data

US 2002/0043261 A1 Apr. 18, 2002

(30) Foreign Application Priority Data

Aug. 17, 2000 (DE) ..... 100 40 321

(51) Int. Cl.[7] ..... H05B 3/68; T24C 15/04

(52) U.S. Cl. ..... 219/446.1; 126/198

(58) Field of Search ..... 219/445.1, 446.1, 219/447.1, 452.11, 460.1, 461.1; 126/90 A, 92 AC, 92 A, 198, 280; 349/199; 116/206, 207

(56) References Cited

U.S. PATENT DOCUMENTS 2,710,274 A * 6/1955 Kuehl ..... 101/DIG. 29
3,585,381 A * 6/1971 Hodson et al. ..... 252/299.7
3,886,539 A * 5/1975 Gould, Jr. ..... 219/445.1
3,898,977 A * 8/1975 Draper ..... 126/200
5,589,958 A 12/1996 Lieb
5,997,964 A * 12/1999 Klima, Jr. ..... 349/122
6,104,007 A * 8/2000 Lerner ..... 126/39 H

FOREIGN PATENT DOCUMENTS

| | | |
|---|---|---|
| AT | 202660 | 9/1958 |
| DE | 234298 | 3/1986 |
| DE | 19836732 | 2/2000 |
| DE | 20020984 | 6/2001 |
| JP | 11351729 | 12/1999 |

* cited by examiner

*Primary Examiner*—Sang Paik
(74) *Attorney, Agent, or Firm*—Nils H. Ljungman & Associates

(57) ABSTRACT

There is now provided a stove for cooking food and like appliances with a door having a window and a temperature indicating device. The temperature indicating device can be on a glass door of a heating and/or cooling device, whereby a color change indicates the temperature, and whereby an indicator is provided between two plates of the glass door which consists of two or more plates. The indicator is configured to change color upon the interior temperature of the appliance reaching a predetermined temperature.

6 Claims, 5 Drawing Sheets

ELECTRIC STOVE FOR COOKING FOOD HAVING AN ELECTRICALLY HEATED COOKING SURFACE

BACKGROUND OF THE INVENTION

1. Field of the Invention

This invention relates to a stove for cooking food and like appliances with a door having a window and a temperature indicating device thereon.

2. Background Information

In general terms, a stove for cooking food comprises a stove body, with the stove body being configured with a base and the stove body further being configured with an interior chamber confined by walls comprising side walls, a front wall, and a rear wall.

An oven is disposed in the interior chamber of the stove body and the oven comprising a heating arrangement configured and disposed to provide heating to cook food in the oven. There is further provided control apparatus to control said the heating arrangement.

The oven usually comprises a door in the front wall, which door may comprise a window arrangement, with the window arrangement comprising a viewing area to view the interior of the oven.

U. S. Pat. No. 5,432,321 issued to Gerl on Jul. 11, 1995 discloses an oven which includes a normal heating device, a partial heating capacity device, a first indicator device associated with the normal heating device, a second indicator device associated with the partial heating capacity device, and a control unit. The control unit turns on a full heating capacity of the normal heating device in a preheating phase and turns on the first indicator device to indicate that the normal heating device is on. The control unit turns on the partial heating capacity device in the preheating phase and turns on the second indicator device to indicate the preheating phase. The control unit automatically switches over the normal heating device to a reduced heating capacity in a continued heating phase, when a selected command temperature is reached. The control unit turns off the partial heating capacity device and automatically turns off the second indicator device simultaneously with the switchover to the continued heating phase.

U.S. Pat. No. 5,928,540 issued to Antoine et al. on Jul. 27, 1999 refers to an oven door for closing a cooking chamber of an oven, the door being composed of: a frame on the oven; an inner wall and an outer wall both supported by the frame so that the inner wall is located between the cooking chamber and the outer wall, the inner wall and outer wall being positioned relative to one another to delimit an air space; and ventilation elements for establishing a flow of air between the inner wall and the outer wall in order to maintain the outer wall at a low temperature during a cooking operation, wherein the inner wall is made of glass, and the outer wall is removable from the frame and is made of a plastic material selected to withstand the temperatures to which it will be exposed during any cooking operation.

The window arrangement referred to above may comprise a plurality of panes, for example, a first pane and a second pane, with the second pane being disposed adjacent the first pane, and the first pane being disposed to face towards the interior of the oven upon installation in the stove.

The second pane would be disposed to face towards the exterior of the stove upon installation in the stove.

It would be advantageous, for example, for cleaning the oven to determine the interior temperature of the oven.

A temperature indicating device of the prior art is described in Federal Republic of Germany Published Patent Application No. DOS 19836732 A1 published on Feb. 24, 2000. A temperature-sensing element is attached in the vicinity of the surface of the door and, as the temperature of the door rises, indicates the elevated door temperature by changing color. One essential feature of this device is that it does not indicate the temperature of the interior of the oven, but only the temperature of the door. The element is preferably a film that is attached to the inside of the door and contains chemical substances that visibly change color as the temperature changes. Accordingly, the element must be designed so that it can survive the high temperatures to which it is exposed in ovens. A temperature-sensing element of this type is complex and expensive to manufacture.

U.S. Pat. No. 5,499,597 issued to Kronberg on Mar. 19, 1996 and entitled, "Optical temperature indicator using thermochromic semiconductors," describes thermochromic materials to indicate temperatures, which can be used to indicate hazardous temperatures on hotplates.

In the prior art, bimetallic or electronic sensors are used as the temperature sensors to indicate the temperature of the interior of an oven. These sensors act on a display by means of a corresponding electronic system. Circuits of this type, are complex and expensive to manufacture. They also require power to operate.

International Published Application WO 97/26486 published on July 1997, entitled, "A control device for a domestic oven"; and International Published Application WO 97/34490 published on Sep. 25, 1997, entitled, "A heater unit for ovens," describe various requirements for temperature indicators on the door of a domestic oven.

Austrian Patent No. 202,660 of Sep. 15, 1958 describes a roaster for electric ovens with a thermostatic control that is attached to the door. The controller is located between two shells of the door. A thermally conducting body transmits the heat from the inner shell of the door to a bimetallic switch. There is an indicator light that shows the status of the switch.

U.S. Pat. No. 5,589,958 issued to Lieb on Dec. 31, 1996 and entitled, "Kitchen ensemble having windows with controllable opacity," describes a kitchen arrangement on which the front windows can be switched into a transparent or opaque status.

East German Patent No. DD 234 298 A 1 is for an adhesive film that indicates the temperature. This film is used to indicate the temperature in electric household appliances.

Japanese Published Patent Application JP 11351729 A, corresponding to U.S. Pat. No. 5,996,357 issued to Park on Dec. 7, 1999 and entitled, "System for checking an internal temperature of a refrigerator by using a thermochromic member," describes a device to indicate the interior temperature of a cooling unit. For this purpose, the device has a thermochromic element.

OBJECT OF THE INVENTION

The object of the invention is to provide a stove and like appliance having a window with an indicator device that indicates when a specified temperature range in the interior of a heating and/or cooling device has been reached by changing color, whereby in a heating device, the temperature indicator device is not damaged by the high temperatures inside the oven.

SUMMARY OF THE INVENTION

The invention teaches that this object can be achieved by a stove for cooking food, said stove comprising: a stove body; said stove body being configured with a base; said stove body being configured with an interior confined by walls comprising side walls, a front wall, and a rear wall; an oven disposed in said interior of stove body; said oven comprising a heating arrangement configured and disposed to provide heating to cook food in said oven; control apparatus to control said heating arrangement; said oven comprising a door in said front wall; said door comprising a window arrangement, said window arrangement comprising a viewing area to view the interior of said oven; said window arrangement comprising a first pane and a second pane; said second pane being disposed adjacent said first pane; said first pane being disposed to face towards said interior of said oven upon installation in said stove; said second pane being disposed to face towards the exterior of said stove upon installation in said stove; and an indicator disposed adjacent to or in said second pane; said indicator being configured to change color upon the interior temperature of said oven reaching a predetermined temperature.

The invention teaches that this object can be accomplished, in accordance with one aspect, on a temperature indicator device of the type described above by the features comprising, in accordance with one aspect of the invention, that between two plates of the glass door that consists of two or more plates there is a thermochromic coating, whereby the thermochromic coating is designed and located so that it changes color when the interior temperature of the heating and/or cooling device is from approximately minus twenty-five degrees Celsius (minus thirteen degrees Fahrenheit) to plus one hundred and twenty degrees Celsius (plus two hundred and forty-eight degrees Fahrenheit).

Because the thermochromic coating is provided between two plates of the glass door, it is exposed only indirectly to the temperature of the interior of the oven. It is not exposed to the maximum temperature of the interior of the oven. Therefore, as the thermochromic coating, an economical and thermosensitive color coating can be used that can be attached to the plate in question using the screen printing process or is in the form of a film, preferably a polymer film. The temperature indicator device is therefore significantly more economical than a corresponding electronic temperature display device.

The thermochromic coating does not indicate the door temperature, but the temperature of the interior of the oven. Glass doors consisting of two or more plates are designed so that their outside temperature does not present any hazards to users. Therefore it is not necessary to warn the user about the high temperature of the door.

The location in which the thermochromic coating is applied is preferably selected so that at the maximum temperature of the interior of the oven, which is approximately two hundred and eighty degrees Celsius (five hundred and thirty-six degrees Fahrenheit) to three hundred degrees Celsius (five hundred and seventy-two degrees Fahrenheit), the temperature on the coating does not exceed one hundred and twenty degrees Celsius (two hundred and forty-eight degrees Fahrenheit). Thermosensitive paints that are not damaged at temperatures up to one hundred and twenty degrees Celsius (two hundred and forty-eight degrees Fahrenheit) are available commercially.

In one preferred development of the invention, the thermochromic coating is applied to the inside of the outermost plate of the glass door.

During the operation of the domestic oven, deposits or encrustations or incrustations are formed in the interior. To remove these deposits, the prior art discloses a cleaning process. During this cleaning process, a cleaning fluid is introduced into the interior of the oven, where it evaporates and dissolves the encrustations. The optimum cleaning results can be achieved if the cleaning fluid is introduced when the interior of the oven is at a temperature of approximately forty degrees Celsius (one hundred and four degrees Fahrenheit). The temperature indicator device described above is particularly well suited for making this temperature visible in the form of a change in the color of the thermochromic coating.

The temperature indicator device described above can also be used in other ovens to indicate a characteristic interior temperature or the instantaneous interior temperature. One example of the use of an indicator device as taught by the invention is the indication of residual heat. In this case, residual heat is defined as the heat that remains inside the oven after the oven has been turned off.

Thus, there is provided, in accordance with one aspect of the present invention, a temperature indicating device on a glass door of a heating and/or cooling device, whereby an externally visible color change indicates the temperature.

Additional advantageous developments of the invention are illustrated in the accompanying drawings and the related portions of the description, as well as in the dependent claims.

When the word "invention" is used in this specification, the word "invention" includes "inventions", that is the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
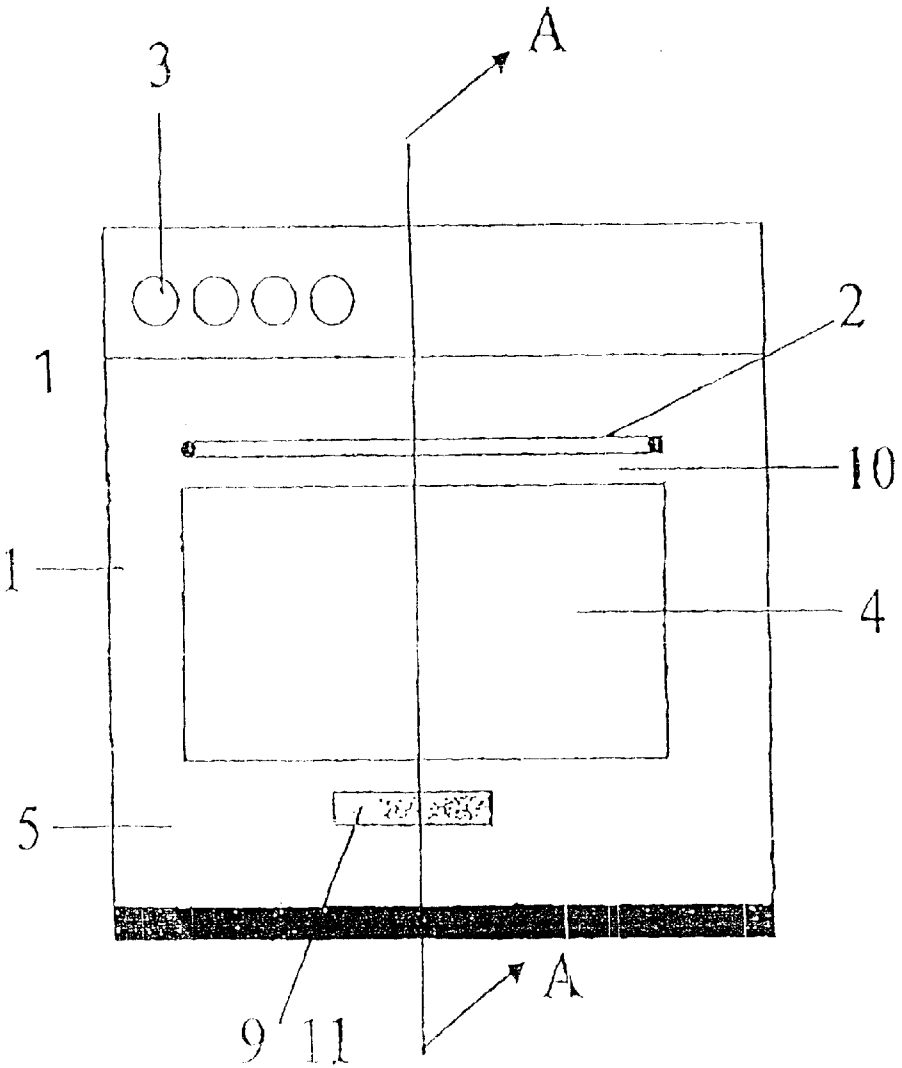
FIG. 1: is a head-on view of a domestic oven with a glass door.
Figure 2:
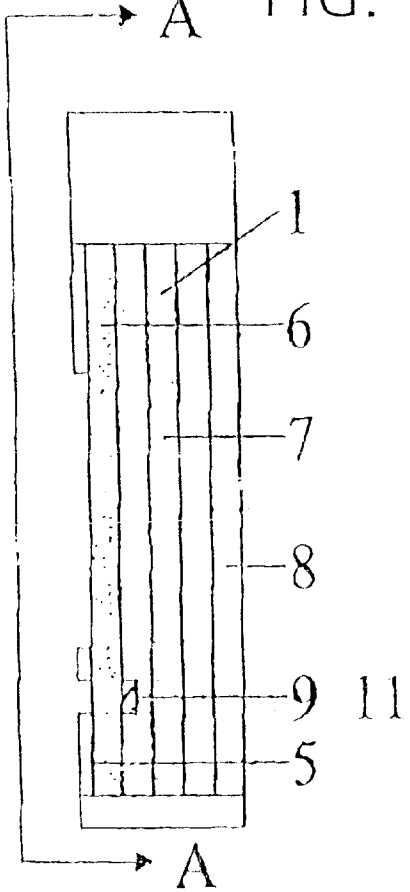
FIG. 2: is a longitudinal section through the glass door of a domestic oven and an overhead view.
Figure 1A:
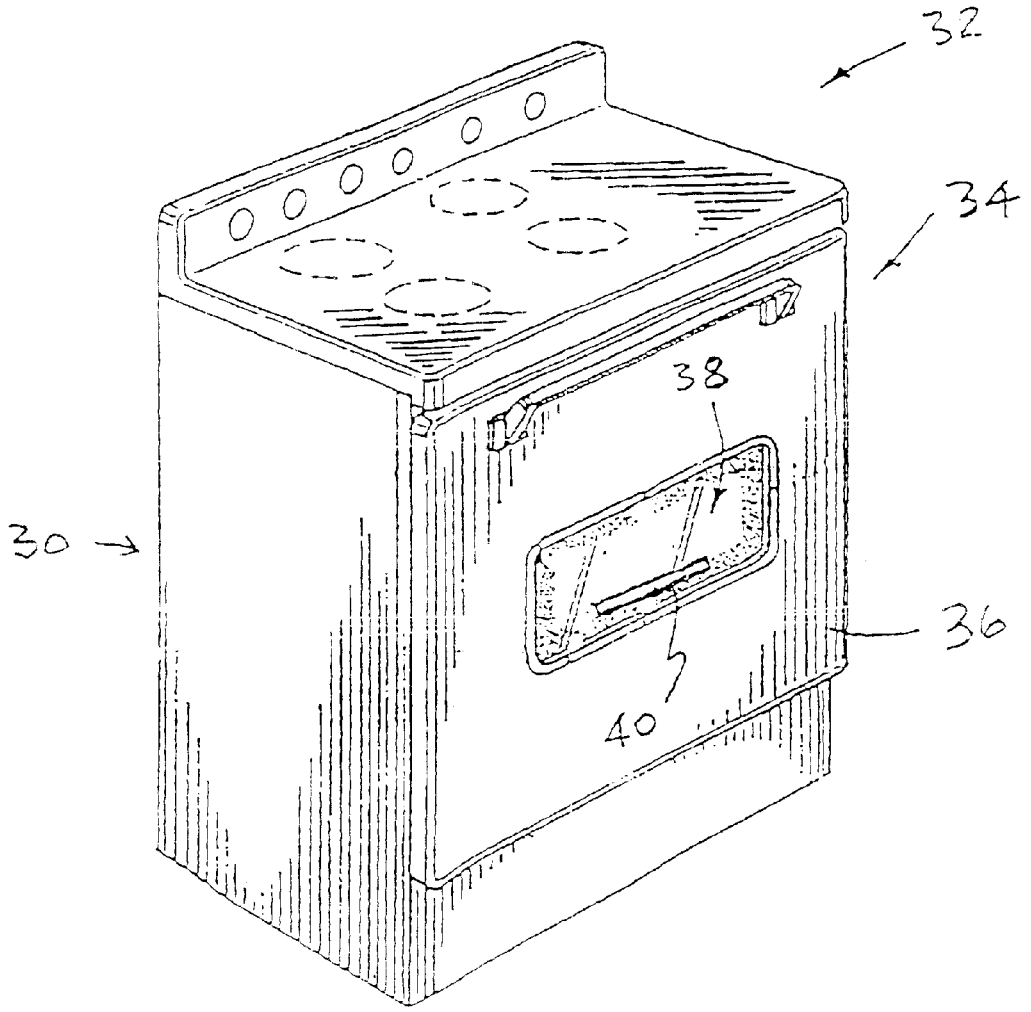
FIG. 1A: is a perspective view of a stove in accordance with the present invention.
Figure 4:
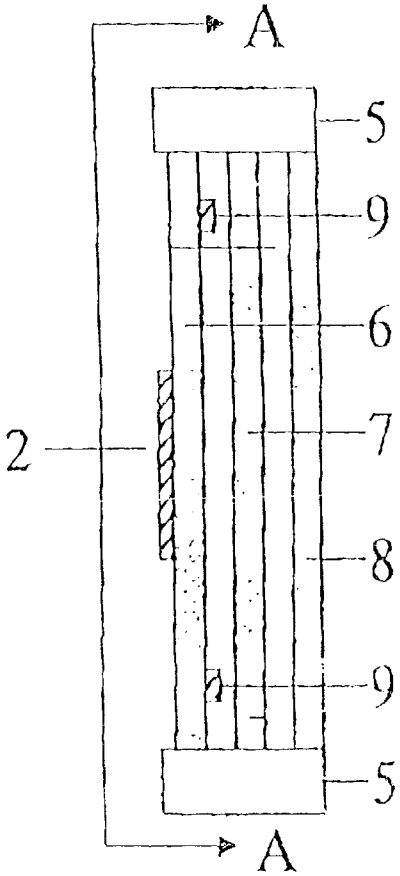
FIG. 4: is a longitudinal section through the glass door of a cooling device and an overhead view.

With reference to FIG. 1A, there is illustrated a stove 30 for cooking food with a cooktop 32 and an oven 34. The oven door 36 has a window 38. Both the cooktop 32 and the window 38 of the oven door 36 can have, for example, relatively easy-to-clean glass ceramic surfaces. Details of the window 38 with its temperature indicating device or indicator 40 are described in greater detail below.

Thus, with reference to FIG. 1, a domestic oven has a glass door (1) as illustrated in FIG. 1, to which a handle (2) is fastened. Above this handle there are various control elements (3). The glass door (1) has a central area (4) that is transparent and as clear as glass, as well as a peripheral area (5) that is provided with a decoration.

The glass door (1) consists of two or generally three plates, namely an outer plate (6), a middle plate (7) and an inner plate (8). A thermochromic coating (9) is applied to the inside of the outer plate (6) and consists of a thermosensitive paint which is printed on the outer plate (6) using the screen printing process, for example, or in the form of a polymer film. The area that contains the thermochromic coating (9) is large enough to be easily visible from the outside. The area that contains the thermochromic coating (9) is large enough to be easily visible from the outside. The thermochromic coating (9) can be realized in the form of letters, numbers or symbols.

The maximum temperature that can be reached in the oven interior (10) can be two hundred and eighty degrees Celsius (five hundred and thirty-six degrees Fahrenheit), for example. Tests have shown that at the maximum temperature of the interior of the oven, the temperature as the location (11) on the outer plate (6) on which the thermochromic coating (9) is provided should not exceed one hundred and five degrees Celsius (two hundred and twenty-one degrees Fahrenheit), which is due to the low location of the position (11) and the thermal insulation of the middle plate (7) and the inner plate (6), as well as to the distances between the inner plate (8) and the middle plate (7) and between the middle plate (7) and the outer plate (6). A thermointensive or, in other words a thermosensitive or responsive to changes in temperature, coating can be used that is reversibly color-stable up to a temperature of one hundred and five degrees Celsius (two hundred and twenty-one degrees Fahrenheit).

The thermochromic coating (9) is selected so that it changes from one color, such as white for example, to green at an oven interior temperature of approximately forty-five degrees Celsius (one hundred and thirteen degrees Fahrenheit). At an oven interior temperature of forty degrees Celsius (one hundred and four degrees Fahrenheit) to forty-five degrees Celsius (one hundred and thirteen degrees Fahrenheit), the temperature on the thermochromic coating (9) is approximately thirty degrees Celsius (eighty-six degrees Fahrenheit). As the oven interior temperature drops from two hundred and eighty degrees Celsius (five hundred and thirty-six degrees Fahrenheit), the thermochromic coating (9) changes from white to green when it reaches the color change temperature. The thermointensive or thermosensitive coating is selected so that the color change temperature is reached when the temperature inside the oven is approximately fifty degrees Celsius (one hundred and twenty-two degrees Fahrenheit) to sixty degrees Celsius (one hundred and forty degrees Fahrenheit) which is the temperature at which the best results are achieved in the oven cleaning process. The user can tell from the color change that the right temperature has been reached at which to introduce a cleaning fluid into the interior (10) of the furnace, or stove or oven. At that point, the user opens the glass door (1), introduces the cleaning fluid and closes the glass door (1). Then the oven heating system is turned back on either manually or automatically, the cleaning fluid vaporizes and its vapors dissolve encrustations in the interior of the oven.

The indicator device claimed by the invention can also be used to indicate the residual heat in the interior (10) of the oven. As the temperature inside the oven drops from temperatures as high as approximately one hundred and sixty degrees Celsius (three hundred and twenty degrees Fahrenheit) to a lower temperature, the coating changes color. The residual heat can then be used for another purpose.

In other exemplary embodiments, depending on the temperature conditions and the thermochromic coating (9) to be used, the thermochromic coating (9) can also be provided at other locations on the plates (6, 7, 8).

Figure 3:
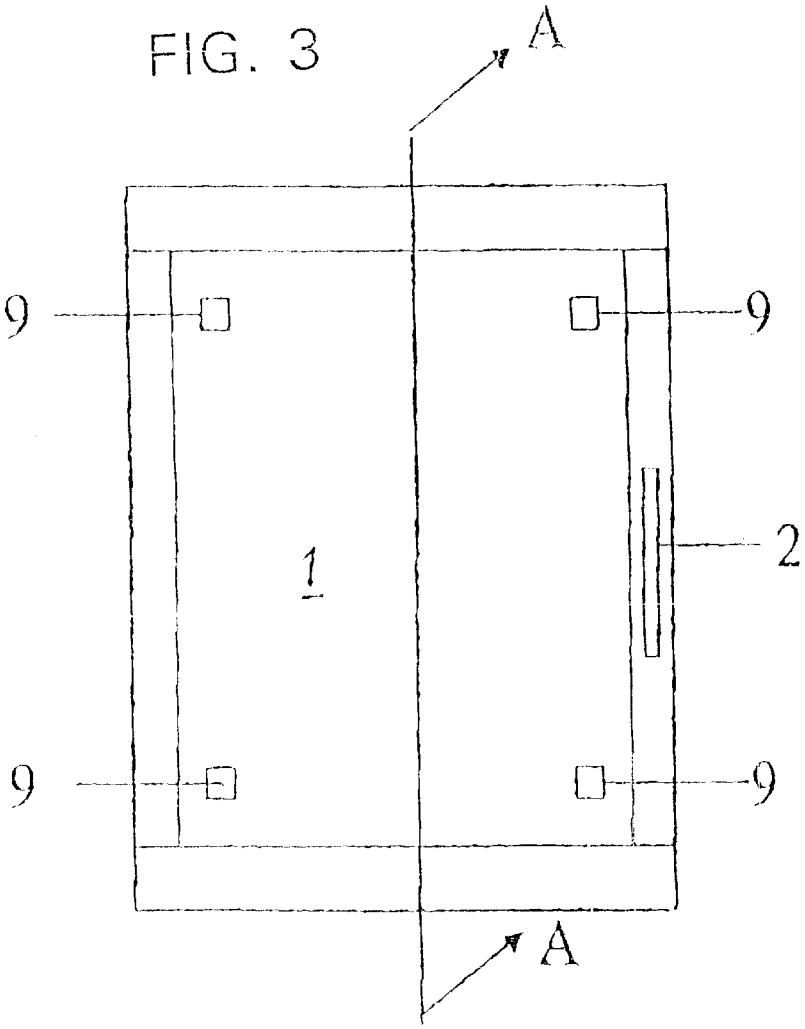
FIG. 3: is a head-on view of a cooling device.

A cooling unit has a glass door (1) as illustrated in FIG. 3, to which a handle (2) is fastened. The glass door (1) consists of two or generally three plates, namely an outer plate (6), a middle plate (7) and an inner plate (8). Preferably four thermochromic coatings (9) are applied to the interior of the outer plate (6). These coatings consist of thermosensitive paint that can be printed on the outer plate (6) using the screen printing process, for example, or can be applied in the form of polymer film. The area that contains the thermochromic coating (9} is large enough to be easily visible from outside.

The thermochromic coating (9) can be in the form of characters or symbols. The thermochromic coating (9) is selected so that it changes color at an interior temperature of approximately five degrees Celsius (forty-one degrees Fahrenheit).

Figure 5:
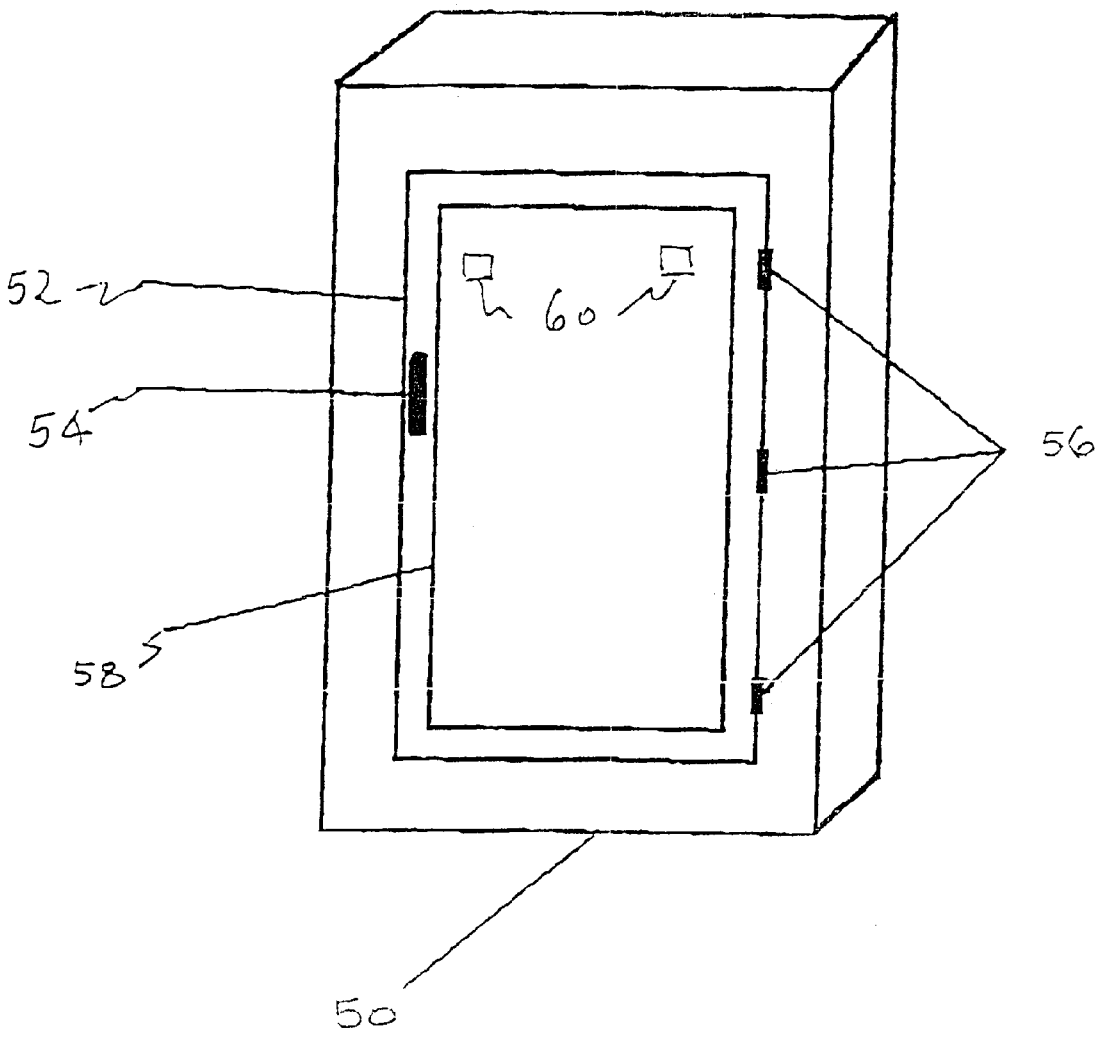
FIG. 5: is a perspective view of a refrigerator or freezer in accordance with the present invention.

FIG. 5 illustrates a refrigerator or freezer 50 having a door 52 with a handle 54 and hinges 56. The door has a viewing glass or window 58. Temperature indicators as described above are identified by reference numeral 60.

Figure 6:
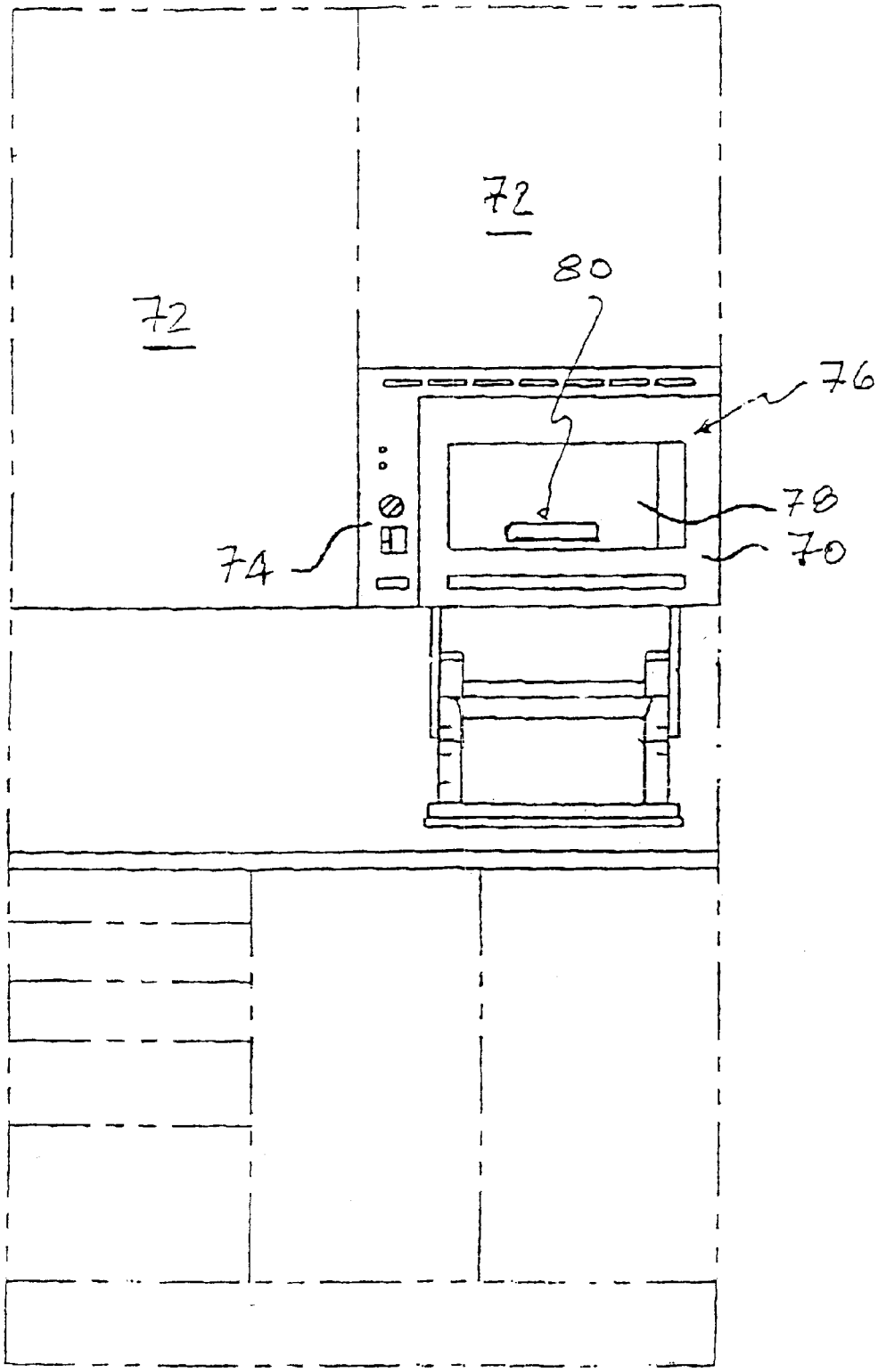
FIG. 6: is an elevation showing a wall mounted oven in accordance with the present invention.

FIG. 6 illustrates an oven 70 that is wall-mounted in a shelf arrangement 72. The oven 70 has a control arrangement 74 and a door 76 with a window 78. Reference numeral 80 indicates a temperature indicator as described above.

It will be understood that the temperature indicator referred to above is disposed in a window comprising panes that are selected and disposed to take into account the interior temperature that is to be indicated on the window.

In other words, the thermal conductivity of the panes or the coefficient of thermal conductivity of the panes will be a determining factor, as will be the number of panes, the type of glass, including the thickness of the glass, can be determined by calculation or experimentation.

Further in other words, the configuration and relative position of the temperature indicator away from the interior of the appliance is such that the temperature drop between the interior of the appliance and the temperature indicator is known or determined by corresponding determinations such as calculation or experimentation.

Experimentation could include a temperature sensor such as a thermistor disposed at the temperature indicator discussed above, which would measure the temperature at the temperature indicator. For such measurements, the thickness, types of glass etc. could be determined by experimentation such that a desired temperature is present at the temperature indicator at a desired temperature in the oven or the like appliance. By changing the thickness, number and types of glass in the panes, the desired temperature can be obtained at the temperature indicator for a specific temperature in the oven or like appliance.

One feature of the invention resides broadly in the temperature indicator device on a glass door of a heating and/or cooling device, whereby an externally visible color change is used to indicate the temperature, characterized by the fact that between two plates 6, 7, 8 of the glass door 1 that consists of two or more plates, there is a thermochromic coating 9, whereby the thermochromic coating 9 is designed and located so that it changes color when the interior temperature of the heating and/or cooling device is from approximately minus twenty-five degrees Celsius (minus thirteen degrees Fahrenheit) to plus one hundred and twenty degrees Celsius (plus two hundred and forty-eight degrees Fahrenheit).

Another feature of the invention resides broadly in the temperature indicator device characterized by the fact that the thermochromic coating 9 is applied in the space inside the glass door 1 on one of the plates 6, 7, 8.

Yet another feature of the invention resides broadly in the temperature indicator device characterized by the fact that the thermochromic coating 9 is applied in a transparent peripheral area of the glass door 1.

Still another feature of the invention resides broadly in the temperature indicator device characterized by the fact that the thermochromic coating 9 is applied on the inside of the outer plate 6.

A further feature of the invention resides broadly in the temperature indicator device characterized by the fact that the thermochromic coating 9 is located in an area 5 of the glass door 1 that is provided with a decoration.

Another feature of the invention resides broadly in the temperature indicator device characterized by the fact that the thermochromic coating 9 is applied using a screen printing process or in the form of a film.

Yet another feature of the invention resides broadly in the temperature indicator device characterized by the fact that the thermochromic coating 9 is in the form of a letter, number or symbol.

Still another feature of the invention resides broadly in the temperature indicator device characterized by the fact that the coating 9, in particular on a heating device, is attached at a location 11 of the glass door 1 in which the temperature at the maximum internal temperature is less than the maximum temperature of the interior of the heating device.

A further feature of the invention resides broadly in the use of a temperature indicator device in a roasting or baking oven, whereby the temperature at which the color changes is selected so that the change occurs at an oven interior temperature from thirty degrees Celsius (eighty-six degrees Fahrenheit) to one hundred and ten degrees Celsius (two hundred and thirty degrees Fahrenheit).

Another feature of the invention resides broadly in the us of a temperature indicator device in a refrigerator or freezer, whereby the color-change temperature is selected so that the color changes at an interior temperature from minus twenty-five degrees Celsius (minus thirteen degrees Fahrenheit) to plus one hundred degrees Celsius (plus two hundred and twelve degrees Fahrenheit).

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

All of the references and documents, cited in any of the documents cited herein, and the references they are in turn cited in, are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

The corresponding foreign and international patent publication applications, namely, Federal Republic of Germany Patent Application No. 100 40 321.2, filed on Aug. 17, 2000, having the title, "TEMPERATURANZEIGEEINRICHTUNG," and having the inventors Kurt LEUTNER, Oliver GROS, Joachim GR ÜTZKE, Bernhard GÖTZ, and Walter GRAMLICH, and DE-OS 100 40 321.2 and DE-PS 100 40 321.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein, are hereby incorporated by reference as if set forth in their entirety herein.

The details in the patents, patent applications and publications may be considered to be incorporable, at Applicants' option, into the claims during prosecution as further limitations in the claims to patentably distinguish any amended claims from any applied prior art.

Some examples of thermochromic materials and uses thereof, features of which may possibly be used or adapted for use in an embodiment of the present invention may be found in the following U.S. Pat. No. 4,236,156 issued to Eden on Nov. 25, 1980 and entitled, "Switching of thermochromic and pressure sensitive films with surface acoustic waves," U.S. Pat. No. 4,339,951 issued to Yee et al. on Jul. 20, 1982 and entitled, "Temperature measurement and display of indicia using thermochromic polyacetylenes," U.S. Pat. No. 4,400,412 issued to Scanlon et al. on Aug. 23, 1983 and entitled, "Thermochromic vanadium oxide coated glass," U.S. Pat. No. 4,445,787 issued to Parker on May 1, 1984 and entitled, "Surface temperature measuring device with reversible thermochromic film," No. 4,661 issued to Carlomagno on Apr. 28, 1987 and entitled, "Method of making a substrate using a markable thermochromic article," U.S. Pat. No. 4,983,810 issued to Balderson and entitled, "Heating unit with thermochromic region," U.S. Pat. No. 5,202,677 issued to Parker et al on Apr. 13, 1993 and entitled, "Display apparatus using thermochromic material," U.S. Pat. No. 5,352,649 issued to Shibahashi et al. on Oct. 4, 1994 and entitled, "Thermochromic laminate member, and composition and sheet for producing the same," U.S. Pat. No. 5,527,385 issued to Sumii et al. on Jun. 18, 1996 and entitled, "Thermochromic composition," U.S. Pat. No. 5,558,700 issued to Shibahashi et al. on Sep. 24, 1996 and entitled, "Reversible thermochromic composition," U.S. Pat. No. 5,583,223 issued to Fischer et al. on Dec. 10, 1996 and entitled, "Thermochromic compounds, their preparation and the use thereof," U.S. Pat. No. 5,688,592 issued to Shibahashi et al. on Nov. 18, 1997 and entitled, "Thermochromic laminate comprising light intercepting pigment and light stabilizer," U.S. Pat. No.

5,919,404 issued to Fujita et al. on Jul. 6, 1999 and entitled, "Reversible thermochromic compositions," U.S. Pat. No. 6,039,390 issued to Agrawal et al. on Mar. 21, 2000 and entitled, "Chromogenic window assembly construction and other chromogenic devices," U.S. Pat. No. 6,048,387 issued to Shibahashi et al. on Apr. 11, 2000 and entitled, "Reversible thermochromic composition," and U.S. Pat. No. 6,171,524 issued to Kuchiban on Jan. 9, 2001 and entitled, "Thermochromic coating for outdoor use and method of applying." All of the foregoing patents are hereby incorporated by reference as if set forth in their entirety herein.

Some examples of stoves and ranges which may be utilized or adapted for use in at least one possible embodiment of the present invention may be found in the following U.S. Pat. No. 5,083,010, having inventors Henry et al., issued on Jan. 21, 1992; U.S. Pat. No. 4,601,279, having inventor Guerin, issued on Jul. 22, 1986; U.S. Pat. No. 4,493,976, having inventor Wilson, issued on Jan. 15, 1985; U.S. Pat. No. 4,292,501, having inventor Maitenaz, issued on Sep. 29, 1981; U.S. Pat. No. 5,213,091, issued on May 25, 1993; No. D336,210, issued on Jun. 8, 1993; U.S. Pat. No. 5,280,152, issued on Jan. 18, 1994; U.S. Pat. No. 5,290,997, issued on Mar. 1, 1994; U.S. Pat. No. 5,400,765, issued on Mar. 28, 1995; No. D359,345, issued on Jun. 13, 1995; No. D361,015, issued on Aug. 8, 1995; and U.S. Pat. No. 5,464,005, issued on Nov. 7, 1995. The aforementioned patents are hereby incorporated by reference as if set forth in their entirety herein.

Some examples of oven glass, features of which may be used or adapted for use in at least one embodiment of the present invention may be found in the following U.S. Pat. No. 4,014,312 issued to McKelvey et al. on Mar. 29, 1977; U.S. Pat. No. 4,084,571 issued to McFarland on Apr. 18, 1978; U.S. Pat. No. 4,206,338 issued to Katona on Jun. 3, 1980; U.S. Pat. No. 4,601,772 issued to McKelvey on Jul. 22, 1986; U.S. Pat. No. 4,898,147 issued to Domi et al. on Feb. 6, 1990; U.S. Pat. No. 4,951,652 issued to Ferrario et al. on Aug. 28, 1990; U.S. Pat. No. 5,441,036 issued to Mikalauskas, II et al. on Aug. 15, 1995; U.S. Pat. No. 6,024,084 issued to Gerhardinger on Feb. 15, 2000; U.S. Pat. No. 6,068,720 issued to McHugh on May 30, 2000; and U.S. Pat. No. 6,138,663 issued to Nomura et al. on Oct. 31, 2000. The aforementioned patents are hereby incorporated by reference as if set forth in their entirety herein.

Some examples of burners and related components which may be utilized or adapted for use in at least one possible embodiment of the present invention may be found in the following U.S. Pat. No. 4,348,571, issued to Dills on Sep. 7, 1982 and entitled, "Flux shaping arrangement for induction surface unit"; U.S. Pat. No. 4,758,710, issued to Crossley et al. on Jul. 19, 1988 and entitled, "Heating apparatus"; U.S. Pat. No. 5,186,158, issued to Ferlin on Feb. 16, 1993 and entitled, "Gas burner"; U.S. Pat. No. 5,329,918, issued to Di Bari on Jul. 19, 1994 and entitled, "Combined electric and gas burner"; U.S. Pat. No. 5,400,765, issued to Goldstein et al. on Mar. 28, 1995 and entitled, "Selective emissive cooking stove". The aforementioned patents are hereby incorporated by reference as if set forth in their entirety herein.

Some examples of related components for stoves and ranges which may be utilized or adapted for use in at least one possible embodiment of the present invention may be found in the following U.S. Pat. No. 5,220,155, issued on Jun. 15, 1993; U.S. Pat. No. 5,245,159, issued on Sep. 14, 1993; U.S. Pat. No. 5,343,020, issued on Aug. 30, 1994; U.S. Pat. No. 5,377,660, issued on Jan. 3, 1995; U.S. Pat. No. 5,380,985, issued on Jan. 10, 1995; and U.S. Pat. No. 5,400,766, issued on Mar. 28, 1995. The aforementioned patents are hereby incorporated by reference as if set forth in their entirety herein.

Some examples of cooking hobs and cooktops which may be utilized or adapted for use in at least one possible embodiment of the present invention may be found in the following U.S. Pat. Nos. 5,406,932, issued on Apr. 18, 1995; 5,422,460, issued on Jun. 6, 1995; 5,424,512, issued on Jun. 13, 1995; 5,425,353, issued on Jun. 20, 1995; 5,429,114, issued on Jul. 4, 1995; and 5,448,036, issued on Sep. 5, 1995. The aforementioned patents are hereby incorporated by reference as if set forth in their entirety herein.

U.S. Pat. No. 6,268,594 issued to Leutner et al. on Jul. 31, 2001 and entitled, "Appliance such as a refrigerator or freezer with a transparent viewing door and a method of manufacture of a refrigerator or freezer with a transparent viewing door," is hereby incorporated by reference as if set forth in its entirety herein.

Examples of display refrigerators and/or display freezers may be found in the following U.S. Pat. No. 4,691,486, entitled, "Glass assembly for refrigerator doors and method of manufacture," U.S. Pat. No. 5,778,689, entitled, "System for maintaining refrigeration doors free of frost and condensation," U.S. Pat. No. 5,552,581 entitled, "Defrost heater for cooling appliance," U.S. Pat. No. 5,329,736 entitled, "Door construction for vertical refrigerator and freezer spaces," U.S. Pat. No. 5,090,175 entitled, "Freezer apparatus," U.S. Pat. No. 4,855,567 entitled "Frost control system for high-speed horizontal folding doors," U.S. Pat. No. 4,658,533 entitled, "Multi-windowpane structure for use in a temperature controlled environment," and U.S. Pat. No. 4,496,201 entitled, "Closure such as a glass door for a refrigerator or freezer." These patents are hereby incorporated by reference as if set forth in their entirety herein.

Some examples of refrigerators and freezers, features of which may possibly be used or adapted for use in at least one embodiment of the present invention may be found in the following U.S. Pat. Nos. 6,109,048 issued to Kim on Aug. 29, 2000; 6,116,036 issued to Canavesi et al. on Sep. 12, 2000; 6,138,460 issued to Lee on Oct. 31, 2000; 6,185,948 issued to Niki et al. on Feb. 13, 2001; 6,189,335 issued to Ebara et al. on Feb. 20, 2001; 6,220,044 issued to Sakurai et al on Apr. 24, 2001; 6,233,961 issued to Ashida et al. on May 22, 2001; 6,240,739 issued to Hayes on Jun. 5, 2001; 6,244,061 issued to Takagi et al. on Jun. 12, 2001; 6,235,561 issued to Imakubo eon Jul. 3, 2001; and 6,266,968 issued to Redlich on Jul. 31, 2001. These patents are hereby incorporated by reference as if set forth in their entirety herein.

The following references, also referred to above, are to be incorporated by reference, as follows: Federal Republic of Germany Published Patent Application No. DOS 19836732 A1 published on Feb. 24, 2000; U.S. Pat. No. 5,499,597 issued to Kronberg on Mar. 19, 1996 and entitled, "Optical temperature indicator using thermochromic semiconductors;" International Published Application WO 97/26486 published on July 1997, entitled, "A control device for a domestic oven"; International Published Application WO 97/34490 published on Sep. 25, 1997, entitled, "A heater unit for ovens;" Austrian Patent No. 202,660 of Sep. 15, 1958; U.S. Pat. No. 5,589,958 issued to Lieb on Dec. 31, 1996 and entitled, "Kitchen ensemble having windows with controllable opacity;" East German Patent No. DD 234 298 A 1 of Mar. 26, 1986; and Japanese Published Patent Application JP 11351729 A, corresponding to U.S. Pat. No. 5,996,357 issued to Park on Dec. 7, 1999 and entitled, "System for checking an internal temperature of a refrigerator by using a thermochromic member." All of these references are hereby incorporated as if set forth in their entirety herein.

Some examples of screen printing, features of which may possibly be used or adapted for use in an embodiment of the present invention may be found in the following U.S. Pat. No. 5,509,964 issued to Boaz on Apr. 23, 1996 and entitled, "Apparatus and method for applying a coating to glass using a screen printing process," U.S. Pat. No. 5,678,481 issued to Matsumoto et al. on Oct. 21, 1997 and entitled, "Method of screen printing a pattern on an edge of a glass substrate," U.S. Pat. No. 5,891,520 issued to Makar et al. on Apr. 6, 1999 and entitled, "Method for screen printing glass articles," U.S. Pat. No. 6,032,576 issued to Collins on Mar. 7, 2000 and entitled, "Method and apparatus for screen printing on a hard substrate," U.S. Pat. No. 6,105,495 issued to Takahashi et al. on Aug. 22, 2000 and entitled, "Screen printing apparatus and screen printing method," and U.S. Pat. No. 6,196,127 issued to Yamamoto et al. on Mar. 6, 2001 and entitled, "Screen process printing method and screen printing machine." All of these U.S. patents are hereby incorporated as if set forth in their entirety herein.

Some examples of thermochromic applications related to refrigerators and freezers, and the like, features of which may possibly be used or adapted for use in an embodiment of the present invention may be found in the following U.S. Pat. No. 4,028,118 issued to Nakasuji et al on Jun. 7, 1977 and entitled, "Thermochromic materials," U.S. Pat. No. 5,165,797 issued to Kuroda et al on Nov. 24, 1992 and entitled, "Thermochromic composite oxide and method for detecting temperature therewith," U.S. Pat. No. 5,401,947 issued to Poland on Mar. 28, 1995 and entitled, "Information display and product identification system," U.S. Pat. No. 5,490,956 issued to Kito et al. on Feb. 13, 1996 and entitled, "Thermochromic opaque composition, laminate member employing the same, and three-dimensional member employing said laminate member and capable of concealing and revealing the interior," U.S. Pat. No. 5,585,425 issued to Kito et al. on Dec. 17, 1996 and entitled, "Thermochromic opaque composition, laminate member employing the same, and three-dimensional member employing said laminate member and capable of concealing and revealing the interior," U.S. Pat. No. 5,858,914 issued to Shibahashi et al. on Jan. 12, 1999 and entitled, "Thermochromic coloring color-memory footwear," and U.S. Pat. No. 6,059,420 issued to Rogers on May 9, 2000 and entitled, "See through refrigerator door assembly." All of the foregoing U.S. Patents are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An electric stove for cooking food, said electric stove comprising:

a stove body;

said stove body comprising a bottom base portion;

said stove body comprising an upper housing portion;

an electric cook top;

said electric cook top being mounted in or on said upper housing portion;

said electric cook top being configured to provide heat to a cooking utensil placed thereon;

said electric cook top comprising an electrically heated cooking surface;

said electrically heated cooking surface comprising at least one of an electric heating unit and an electric hotplate unit;

said stove body being configured with an interior and an exterior, said interior being confined by walls comprising side walls, a front wall, and a rear wall;

said walls being disposed between and to connect said lower base portion and said upper housing portion;

control apparatus to control said electrically heated cooking surface;

said interior of said stove body comprising an oven;

said front wall comprising a door to permit access to said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said stove body and comprising the outermost surface of said glass window arrangement;

said second surface of said first pane being disposed to face toward the interior of said stove body;

said first surface of said second pane being disposed to face toward the exterior of said stove body;

said second surface of said second pane being disposed to face toward the interior of said stove body;

said second surface of said first pane being disposed adjacent said first surface of said second pane;

a thermochromic coating disposed on said second surface of said first pane to insulate said thermochromic coating from exposure to high internal temperatures of said oven;

said thermochromic coating being configured to change color upon a predetermined internal temperature of said oven being reached, said predetermined internal temperature being below 120 degrees Celsius and being a temperature at which to introduce a cleaning solution into said oven to clean said oven;

said thermochromic coating being applied on a transparent peripheral area of said first pane;

said first pane comprising a decoration disposed adjacent said thermochromic coating;

said thermochromic coating being one of: a screen-printed coating and a film coating; and said thermochromic coating being in the shape of at least one of: a letter, a number, and a symbol.

2. An electric stove for cooking food, said electric stove comprising:

a stove body;

said stove body comprising a bottom base portion;

said stove body comprising an upper housing portion;

an electric cook top;

said electric cook top being mounted in or on said upper housing portion;

said electric cook top being configured to provide heat to a cooking utensil placed thereon;

said electric cook top comprising an electrically heated cooking surface;

said electrically heated cooking surface comprising at least one of an electric heating unit and an electric hotplate unit;

said stove body being configured with an interior and an exterior, said interior being confined by walls comprising side walls, a front wall, and a rear wall;

said walls being disposed between and to connect said lower base portion and said upper housing portion;

control apparatus to control said electrically heated cooking surface;

said interior of said stove body comprising an oven;

said front wall comprising a door to permit access to said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said stove body and comprising the outermost surface of said glass window arrangement;

said second surface of said first pane being disposed to face toward the interior of said stove body;

said first surface of said second pane being disposed to face toward the exterior of said stove body;

said second surface of said second pane being disposed to face toward the interior of said stove body;

said second surface of said first pane being disposed adjacent said first surface of said second pane;

a thermochromic coating disposed on said second surface of said first pane to insulate said thermochromic coating from exposure to high internal temperatures of said oven;

said thermochromic coating being configured to change color upon a predetermined internal temperature of said oven being reached, said predetermined internal temperature being below 120 degrees Celsius and being a temperature at which to introduce a cleaning solution into said oven to clean said oven;

said thermochromic coating being applied on a transparent peripheral area of said first pane;

said thermochromic coating being one of: a screen-printed coating and a film coating; and said thermochromic coating being in the shape of at least one of: a letter, a number, and a symbol.

3. An electric stove for cooking food, said electric stove comprising:

a stove body;

said stove body comprising a bottom base portion;

said stove body comprising an upper housing portion;

an electric cook top;

said electric cook top being mounted in or on said upper housing portion;

said electric cook top being configured to provide heat to a cooking utensil placed thereon;

said electric cook top comprising an electrically heated cooking surface;

said electrically heated cooking surface comprising at least one of an electric heating unit and an electric hotplate unit;

said stove body being configured with an interior and an exterior, said interior being confined by walls comprising side walls, a front wall, and a rear wall;

said walls being disposed between and to connect said lower base portion and said upper housing portion;

control apparatus to control said electrically heated cooking surface;

said interior of said stove body comprising an oven;

said front wall comprising a door to permit access to said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said stove body and comprising the outermost surface of said glass window arrangement;

said second surface of said first pane being disposed to face toward the interior of said stove body;

said first surface of said second pane being disposed to face toward the exterior of said stove body;

said second surface of said second pane being disposed to face toward the interior of said stove body;

said second surface of said first pane being disposed adjacent said first surface of said second pane;

a thermochromic coating disposed on said second surface of said first pane to insulate said thermochromic coating from exposure to high internal temperatures of said oven;

said thermochromic coating being configured to change color upon a predetermined internal temperature of said oven being reached, said predetermined internal temperature being below 120 degrees Celsius; and said thermochromic coating being in the shape of at least one of: a letter, a number, and a symbol.

4. An electric stove for cooking food, said electric stove comprising:

a stove body;

said stove body comprising a bottom base portion;

said stove body comprising an upper housing portion;

an electric cook top;

said electric cook top being mounted in or on said upper housing portion;

said electric cook top being configured to provide heat to a cooking utensil placed thereon;

said electric cook top comprising an electrically heated cooking surface;

said electrically heated cooking surface comprising at least one of an electric heating unit and an electric hotplate unit;

said stove body being configured with an interior and an exterior, said interior being confined by walls comprising side walls, a front wall, and a rear wall;

said walls being disposed between and to connect said lower base portion and said upper housing portion;

control apparatus to control said electrically heated cooking surface;

said interior of said stove body comprising an oven;

said front wall comprising a door to permit access to said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said stove body and comprising the outermost surface of said glass window arrangement;

said second surface of said first pane being disposed to face toward the interior of said stove body;

said first surface of said second pane being disposed to face toward the exterior of said stove body;

said second surface of said second pane being disposed to face toward the interior of said stove body;

said second surface of said first pane being disposed adjacent said first surface of said second pane;

a thermochromic coating disposed on said second surface of said first pane to insulate said thermochromic coating from exposure to high internal temperatures of said oven; and said thermochromic coating being configured to change color upon a predetermined internal temperature of said oven being reached, said predetermined internal temperature being below 120 degrees Celsius.

5. An oven for cooking food, said oven having an interior and an exterior and comprising:

a door to permit access to the interior of said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said oven and comprising the outermost surface of said glass window arrangement;

said second surface of said first pane being disposed to face toward the interior of said oven;

said first surface of said second pane being disposed to face toward the exterior of said oven;

said second surface of said second pane being disposed to face toward the interior of said oven;

said second surface of said first pane being disposed adjacent said first surface of said second pane;

a thermochromic coating disposed on said second surface of said first pane to insulate said thermochromic coating from exposure to high internal temperatures of said oven;

said thermochromic coating being configured to change color upon a predetermined internal temperature of said oven being reached, said predetermined internal temperature being below 120 degrees Celsius and being a temperature at which to introduce a cleaning solution into said oven to clean said oven;

said thermochromic coating being applied on a transparent peripheral area of said first pane;

said first pane comprising a decoration disposed adjacent said thermochromic coating;

said thermochromic coating being one of: a screen-printed coating and a film coating; and said thermochromic coating being in the shape of at least one of: a letter, a number, and a symbol.

6. An oven for cooking food, said oven having an interior and an exterior and comprising:

a door to permit access to the interior of said oven;

a glass window arrangement disposed in said door to permit viewing of the interior of said oven;

said glass window arrangement comprising at least a first pane and a second pane;

said first pane having a first surface and a second surface disposed opposite said first surface;

said second pane having a first surface and a second surface disposed opposite said first surface;

said first pane being disposed adjacent said second pane;

said first surface of said first pane being disposed to face toward the exterior of said oven and comprising the outermost surface of said glass window arrangement;

said second surface of said first pane being disposed to face toward the interior of said oven;

said first surface of said second pane being disposed to face toward the exterior of said oven;

said second surface of said second pane being disposed to face toward the interior of said oven;

said second surface of said first pane being disposed adjacent said first surface of said second pane;

a thermochromic coating disposed on said second surface of said first pane to insulate said thermochromic coating from exposure to high internal temperatures of said oven; and said thermochromic coating being configured to change color upon a predetermined internal temperature of said oven being reached, said predetermined internal temperature being below 120 degrees Celsius.

* * * * *

UNITED STATES PATENT AND TRADEMARK OFFICE

CERTIFICATE OF CORRECTION

PATENT NO. : 6,555,794 B2
DATED : April 29, 2003
INVENTOR(S) : Kurt Leutner et al.

It is certified that error appears in the above-identified patent and that said Letters Patent is hereby corrected as shown below:

Title page,
Item [73], Assignee, delete "Assignee:" and insert -- Assignees: -- ;
and add following second Assignee: -- BSH Bosch und Siemens Hausgerate GmbH, Munchen (DE) --.

Signed and Sealed this

Twenty-second Day of June, 2004

JON W. DUDAS
*Acting Director of the United States Patent and Trademark Office*